United States Patent [19]

Bernhardt et al.

[11] 4,106,465

[45] Aug. 15, 1978

[54] OFF-ON-START SWITCHING SYSTEM FOR DIESEL ENGINES, AND PARTICULARLY AUTOMOTIVE-TYPE DIESEL ENGINES

[75] Inventors: Walter Bernhardt, Fellbach; Bodo Ziegler, Stuttgart, both of Germany

[73] Assignee: Robert Bosch GmbH, Stuttgart, Germany

[21] Appl. No.: 796,994

[22] Filed: May 16, 1977

[30] Foreign Application Priority Data

Jun. 2, 1976 [DE] Fed. Rep. of Germany ..... 2624685

[51] Int. Cl.[2] ..... F02N 17/00

[52] U.S. Cl. ..... 123/179 H; 123/179 BG

[58] Field of Search ..... 123/179 H, 179 BG

[56] References Cited

U.S. PATENT DOCUMENTS

| | | | |
|---|---|---|---|
| 3,371,656 | 3/1968 | Stauffer et al. | 123/179 H |
| 3,551,686 | 12/1970 | Koehler et al. | 123/179 H |
| 3,675,033 | 7/1972 | Richard et al. | 123/179 H |
| 3,708,683 | 1/1973 | Howland | 123/179 H |

FOREIGN PATENT DOCUMENTS

| | | | |
|---|---|---|---|
| 2,300,229 | 3/1976 | France | 123/179 H |
| 2,360,841 | 6/1975 | Fed. Rep. of Germany | 123/179 H |
| 2,225,662 | 12/1973 | Fed. Rep. of Germany | 123/179 H |
| 2,205,108 | 11/1972 | Fed. Rep. of Germany | 123/179 H |
| 2,323,485 | 11/1974 | Fed. Rep. of Germany | 123/179 H |
| 1,299,589 | 12/1972 | United Kingdom | 123/179 H |

*Primary Examiner*—Charles J. Myhre
*Assistant Examiner*—David D. Reynolds
*Attorney, Agent, or Firm*—Flynn & Frishauf

[57] ABSTRACT

To simplify the circuitry and improve reliability of pre-heat, glow-plug or the like operation while using a conventional automotive OFF-ON-START switch, a momentary-operation pre-heat switch is included in the circuit, as well as a heat-sensitive relay and a timing circuit, the heat-sensitive relay determining if pre-heating has been sufficient, and the timing relay then providing a limited time period to permit starting of the engine while still maintaining pre-heat conditions but discontinuing pre-heat conditions if starting is not commanded.

9 Claims, 2 Drawing Figures

Figure 1:
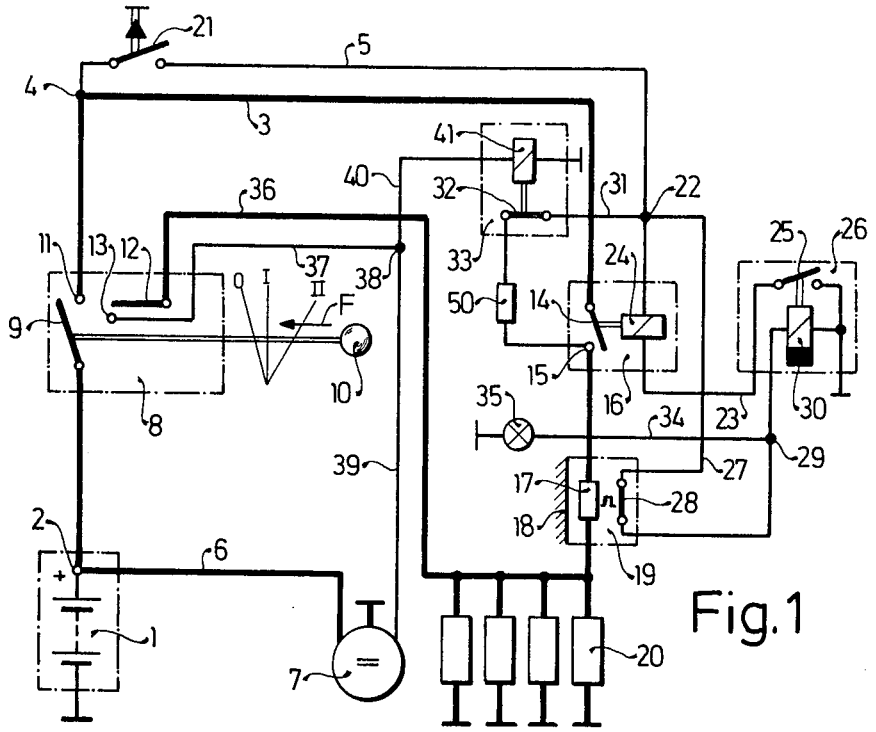

OFF-ON-START SWITCHING SYSTEM FOR DIESEL ENGINES, AND PARTICULARLY AUTOMOTIVE-TYPE DIESEL ENGINES

Reference to application of related subject matter: U.S. Ser. No. 765,832, filed Feb. 4, 1977 now U.S. Pat. No. 4,075,998, KRAUSS et al., assigned to the assignee of the present application.

German published patent application DT-AS No. 20 52 651.

The present invention relates to a switching system to control Diesel engines, and more particularly to control automotive-type Diesel engines by means of customary automotive OFF-ON-START switches.

Customary automotive controlled switches have three engine control positions, an OFF position (0); a stable ON position (I) which is the ordinary drive position; and a spring-loaded unstable START position (II) to which the switch can be moved for starting but, as soon as the switch handle or ignition key is released, it will snap back automatically to the I or ON position. As used in many automotive vehicles, an additional "accessory" position may be provided.

It is desirable that control switches for use with automotive Diesel engines have similar positions. When applied to Diesel engines, the I or ON position is additionally the pre-heat position for the customarily used glow plugs. The glow plugs are connected in a glow plug heating circuit and a control circuit therefor which includes a resistor forming at the same time the heater winding of a thermal bi-metal switch. The operation of the bi-metal switch controls not only application of current, or interruption of current flow to the glow plugs but additionally provides for current flow to an indicator lamp which, when extinguishing, indicates that the engine is ready to be started. A timing relay may be used which disconnects the heater circuit for the glow plugs after a predetermined time interval. The "START" position, as in a gasoline-type internal combustion engine, connects the starter motor to the internal combustion engine.

To start a Diesel or similar engine, it is frequently necessary to pre-heat the combustion air. During that time interval, which may be variable, electrical current is supplied to glow plugs associated with the Diesel engine before the starting switch is energized. Glow plugs, as herein used, may be various types and may include ignition plugs located in, or in association with the air induction pipe to the internal combustion engine and which, by vaporization and combustion of supplied fuel pre-heat the air being applied to the engine. The electrical supply to the glow plugs must be so arranged that current cannot flow continuously; this is particularly important if the operator of the Diesel engine, after pre-heating the engine by means of the glow plugs, decided not to start the engine but has neglected to discontinue the glow plug heater circuit. The arrangement should be such that the operator receives an indication or a signal which shows when the glow plugs are sufficiently hot to permit ready starting of the engine, in dependence on ambient temperature, or on the temperature of the internal combustion engine, or both. The circuit should, additionally, permit initiation of the starting of the engine at any time. Additionally, initiation of the pre-heat mode or steps should preferably be controlled by a momentary-operating switch, such as a push button or the like, which requires only momentary operation rather than continuous supervision or application of an operating force. The pre-heat time may extend over about a minute or so. Such a system has been described in German patent publication DT-AS No. 20 52 651; this system is comparatively expensive and additionally results in reduced supply of power to the glow plugs since a glow plug resistor is inserted in the circuit.

It is an object of the present invention to provide a control circuit, or control system, including a control switch having OFF-ON-START positions, which is relatively simple and hence inexpensive, and which permits application of full power to the glow plugs upon starting without reduction in energy due to the presence of a series resistor; and which, furthermore, protects the glow plugs to disconnect current from the glow plugs after the engine has started, or after a starting attempt has been made.

SUBJECT MATTER OF THE PRESENT INVENTION

Briefly, the ON terminal of the switch is connected both to a power supply line and to a control line. The power supply line provides power to the glow plugs through a relay which is controlled to close from the control line if the momentary-operating switch is closed. The relay is connected into a self-holding circuit through a normally closed relay. Additionally, current is supplied through the normally closed relay forming the self-holding circuit through the thermostat contact switches of a thermostat exposed to heat from a pre-heat coil sensing current flow to the glow plugs as well as to engine and ambient temperature, or at least one of them, and then to energize a timing relay which further is in circuit with the glow plug control relay. Upon movement of the main switch to the START position, a direct connection is effected from the power supply to the glow plugs, bypassing the thermostat resistor; the timing circuit holds the glow plug energization circuit established at the ON position for a period of 15 seconds, or so, however, while the normally closed relay in the self-holding circuit is additionally energized through further control contact to open. Thus, the glow plugs will remain energized for a maximum period of time, as determined by the timing relay — about 15 seconds, preferably — or until the engine has started, but no longer.

The timing relay itself, in a preferred form of the invention, includes a thermostatic timing relay circuit.

DRAWINGS, ILLUSTRATING AN EXAMPLE

Figure 2:
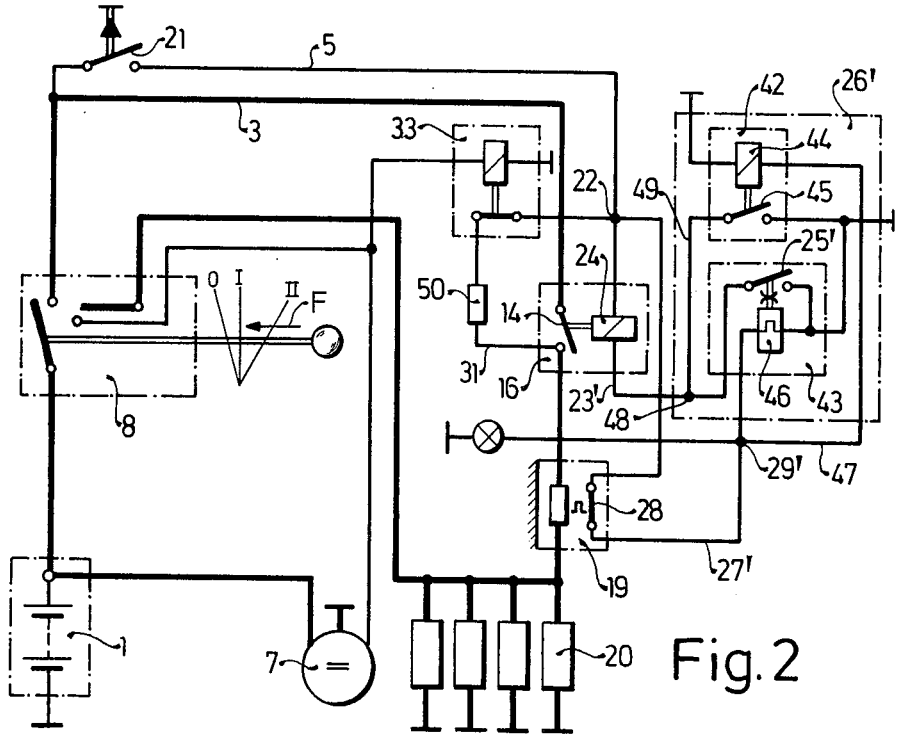

FIG. 1 is a schematic wiring diagram of the basic arrangement in accordance with the present invention, in which power supply conductors are drawn in heavier lines than control conductors;

and FIG. 2 illustrates a modification of the system of FIG. 1, showing a preferred form of the timing relay.

Power supply to the system (FIG. 1) is from a battery 1 having its negative terminal connected to ground, chassis or reference potential, and its positive terminal to a positive output 2. The output 2 is connected to a control switch 8 having OFF (0), ON (I) and START (II) positions. It may have additional positions. The system includes a main junction 4 from which a main glow plug supply line 3 branches to a group of glow plugs 20, shown in the example as parallel connected, although they may also be series connected. A main control line 5 also branches from junction 4. Terminal 2 is further connected to the power supply line 6 for the starter motor 7 for the engine. The starter motor has a built-in starter relay, energized by a starter relay control line 39. Switch 8 has a movable switch contact 9 which is shown in the 0 or OFF position. The II, or START position is unstable, and the switch contact 9 is spring-loaded, as schematically shown by the force arrow F, to return to the I or ON position if it is moved in the II position. When in the OFF position, the switch 9 disconnects all supply of power to the system; the connection line 6 to the starter is interrupted by the starter relay in the starter 7. When the switch 8 is moved to the ON or I position, contact 9 engages contact 11. In the II position, contact 9 engages contacts 12 and 13.

The glow plug supply circuit is as follows: Terminal 11 — junction 4 — line 3 — operating contacts 14, 15 of power relay 16 — resistor 17 of a bi-metal switch 19 — glow plugs 20. The bi-metal switch 19 is preferably exposed to engine temperature, for example by being introduced into the engine cooling water system as schematically shown by the frame connection 18. It has normally closed operating contacts 28.

The glow plug control circuit extends as follows: Switch terminal 11, junction 4, a momentary-operating switch 21, control line 5, junction 22. From junction 22 three branch lines 23, 27, 31 extend. Line 23 passes through the relay winding 24 of the power relay 16. The circuit then continues through the normally open contacts 25 of timing relay 26. The timing relay has a drop-off delay of about 15 seconds. This is a suitable time period to allow the operator of the Diesel engine to start the engine after the engine has been preheated by glow plugs 20. After the starting time, the system shuts down automatically.

The circuit from junction 22 includes a second line 27 which, in the direction of current flow, extends as follows: Normally closed terminals 28 of the thermostatic switch 19, junction 29, control coil 30 of timing relay 26 and ground. From junction 29, a line extends to an indicator lamp 35. A further third branch extends from junction 22: Line 31, normally closed contacts 32 of the control current relay 33, current limiting resistor 50 and terminal 15 of glow plug load relay 16.

Relay 33 may be a normally closed (NC) miniature relay, since its terminals do not carry a high current load.

The lamp 35 indicates, by extinguishing, that the engine is ready to be started.

Terminal 12 of switch 8 is the starting terminal for a second power supply line 36 to the glow plugs 20. There are no other elements in this circuit which would draw current. Thus, connection of terminal 9 of switch 8 to terminal 12 puts battery voltage directly across the glow plugs 20.

Terminal 13 of switch 8 is a control line terminal, and connects to a line 37 which goes to a junction 38. Junction 38 connects to line 39 which controls the starter relay of starter motor 7. The relay is integrated in the starter motor. Junction 38 additionally connects to line 40 which controls the relay winding 41 of relay 33.

Operation: Let it be assumed that the engine is cold and is stopped. The relays and switches will then be in the position shown in FIG. 1.

To start the cold engine, the operator must first move the switch from the OFF position into the ON position I. This connects the switch terminal 9 of switch 8 to contact 11. This position is also the "drive" position and junction 4 may be used to connect other loads, not shown, to the electrical network of the IC engine, or of the vehicle, respectively. As yet, the starting system, as disclosed, does not react to movement of the switch to the "DRIVE" position. The operator must momentarily operate the pushbutton switch 21 to initiate preheating by energizing glow plugs 20. Momentary operation of pushbutton switch 21 has the following result and establishes the following circuits:

Current from battery 1 flow through terminal 2, switch 9, terminal 11, junction 4, switch 21 to line 5; from line 5 it flow to junction 22, line 27, bi-metal strip 28 of switch 19, junction 29 and coil 30 of timing relay 26. Consequently, the normally open (NO) contacts 25 will close. Upon closing of terminals 25 of timing relay 26, current can flow from the glow plug control line 5 through junction 22 and coil 24 of the glow plug load relay 16. Consequently, load relay 16 will close, establishing a circuit through the contacts 14, 15 between the glow plugs and the pre-heat glow plug supply line 3. Current will flow through the resistor 17 of the thermostatic switch 19. As a consequence, both the switch 19 and the glow plugs 20 will heat. Current which branches in the junction 29 of line 27 will cause indicator lamp 35 to light. This indicates to the operator that the glow plugs 20 are in pre-heat condition.

The operator can release the momentary operating switch 21 immediately having first engaged the switch. Current continues to be supplied, however, over a self-holding circuit. The switching state above described will continue since junction 22 is supplied with relay holding current through line 31, contacts 32 of the control relay 33, and dropping resistor 50, connected to terminal 15 of the load relay 16. Thus, lines 23 and 27 are supplied with current from the power contact 15 of the power relay 16. The resistor 50 is a limiting resistor to limit current flowing in line 31 and prevents excessive loading of the terminals of the relay 33.

The circuit 22 — 31 — 32 — 50 — 15 may be termed a relay-controlled sefl-holding circuit.

Bi-metal strip 28 of the thermostat 19 will interrupt current flow through line 27 after a certain temperature pertains within the thermostatic switch 19. This temperature will be determined by the current flow to the glow plugs 20 and additionally by the temperature of the engine cooling water, by ambient temperature, or by both. Consequently, indicator 35 will extinguish and the relay 30 will be de-energized. Extinguishing of indicator 35 indicates to the operator that the glow plugs 20 have sufficiently pre-heated the air to start the engine. Interruption of current flow to relay coil 30 of the timing relay 26 does not, however, initiate immediate drop-out of the power relay 16; rather, a timing period of preferably about 15 seconds is initiated. During this time, glow plugs 20 continue to heat. This is the time during which the operator should start the engine.

To start the engine, the operator must move the terminal 9 of switch 8 by means of handle 10 to the START position II. This brings contacts 12, 13 of the switch 8 in direct connection with the battery 1. Current will now flow from the battery 1 through the main glow plug supply line 36 to the glow plugs 20. There is no other loading element in line 36, so that the glow plugs are directly heated without interposition of any other circuit component which might consume energy. Current will also flow through line 37 to junction 38 to which the starter relay is connected by line 39, thus energizing the starter relay to permit current to flow from line 6 directly from the battery to the starter motor 7. A portion of the current which flows over line 40 energizes the coil 41 of the NC miniature relay 33, thus opening the contacts 32 and interrupting the self-holding circuit. This interrupts the circuit to relay coil 24 of the pre-heat power relay 16; contacts 14, 15 will open. Thus, as soon as the switch terminal 9 is moved to the II position, the pre-heat circuit is disconnected. While the timing relay 26 may continue to remain closed, no current will flow through the operating terminals thereof since junction 22 is de-energized upon opening of the relay 33, which opened the self-holding circuit. Thus, either elapse of the timing interval of the timing relay 26 or movement of the switch 8 to the II position will reset the circuit.

Let it be assumed that the engine starts. The switch can then be released from the II position and it will snap back under the force F of the spring to the I position.

Let it be assumed as a second example that the first attempt to start does not result in starting of the engine and, upon release of switch handle 10, it dies. It is now possible to immediately re-initiate starting by moving the switch again to the II position. This will not only energize the starter 7 but additionally energize the glow plugs 20 through the main supply line 36. If the engine is quite cold, it is recommended, however, not to reinitiate a starting attempt by moving the starter switch to the II position, but rather to leave the switch in the I position and press the pre-heat control switch 21. If indicator 35 lights, an indication is obtained that the engine temperature is still not sufficiently warm and that the glow plugs require additional pre-heating. This is controlled by terminals 28 of the thermostatic switch 19. Terminals 28 are closed when the switch is cold, that is, indicates that the engine, or its components which are to be pre-heated, do not have the required temperature.

The operator might have intended to start the engine and moved switch 8 to the I position and operated the engine pre-heat control button 21 — and then changed his mind. This causes pre-heating of the glow plugs 20. Timing relay 26, however, will disconnect its NO terminals 25 after the timing interval of about 15 seconds. If it is assumed that the operator has not moved the switch 8 in the II position, opening of terminals 25 will interrupt the circuit to the glow plug power relay 16 and thus break terminals 14, 15 and interrupt current flow to the glow plugs 20 from the pre-heating supply line 3. The system has been disconnected.

Let it be assumed as another operating condition that the engine has been operated and is warm. It is then stopped. To re-start the engine, while still warm, it is possible to move the switch 8 directly to the II position and to start the engine 7 without pre-heating the glow plugs 20.

EMBODIMENT OF FIG. 2

The essential components of FIG. 2 are identical to those of FIG. 1 and have been given the same reference numerals and will not be described again. Those elements which are similar have been given prime numerals.

The timing relay has been replaced by a timing relay system 26' which includes a miniature or low-current or control relay 42 and a thermostat bi-metal switch 43 having a predetermined drop-off time. Miniature relay 42 has a control coil 44 and NO contacts 45. The thermostatic switch 43 has a heater winding 46 and NO contacts 25'. The drop-off time of the combined circuit 26' is approximately 15 seconds. It corresponds to the drop-off time of relay 26 of FIG. 1.

Line 27', corresponding to line 27 of FIG. 1, is connected to the heating resistor 46 of the thermostatic switch 43 and then to ground or chassis. Junction 29' is connected to a further line 47 which connects through the operating coil 44 of the miniature relay 42 and then to chassis. Line 23', coming from junction 22, is connected through the relay coil 24 of the power relay 16 to an additional junction 48 which connects, on the one hand, through the NO terminals 25' of the thermostatic switch 43 to ground and, on the other, through an additional line 49 to the NO terminals 45 of miniature relay 42 and then to ground.

OPERATION — FIG. 2

The operation of the timing relay 26' corresponds to that one of relay 26, FIG. 1. Upon operating switch 21, control current over line 5 is applied to junction 22, line 27 with the bi-metal strip 28 of the thermostatic switch 19 and then to junction 29. It then flows over line 47 to close the NO terminals 45 by energizing coil 44 of relay 42. Upon closing of the terminals 45, control current from line 5 through coil 24 of power relay 16 can flow through line 23' and then through junction 48, and over line 49 to the now closed terminals 45 of relay 42. Current also flows in line 27'. This current will heat the thermostat resistor 46 of the thermostatic switch 43. Heating will occur slowly and the thermostatic switch 25 will close after a predetermined time interval.

After the necessary pre-heating time has elapsed, the bi-metal strip 28 of the thermostatic switch 19 interrupts current through line 27' and thus causes interruption of energization of coil 44 of the relay 42. The NO terminals 45 will open. Energization of line 23' is, however, continued through the terminals 25' of the auxiliary thermostatic switch 43 until the drop-off time of switch 43 has elapsed. After elapse of this time — preferably about 15 seconds — the ground circuit through line 23', and hence through coil 24, will open. This causes contacts 14, 15 supplying auxiliary pre-heating current to the glow plugs 20 to be disconnected.

In all other respects, the system of FIG. 2 operates identically to that described in connection with FIG. 1.

Various changes and modifications may be made within the scope of the invention concept.

We claim:

1. Electrical ON-OFF-START operating control system for engines requiring a pre-heat time before starting, such as automotive-type Diesel engines having a source of electrical power (1, 2);

a starter motor (7) and a starter switch means (8, 13) therefor, selectively connecting the motor to the source;

at least one glow plug (20);

a manually operable control switch (8, 9, 11, 12, 13) having the positions, in sequence: OFF (0); ON (I); START (II); and corresponding ON (11) and START (12, 13) terminals and a movable switch member (9) connected to said source (1);

the START position (II) of the control switch (8) being unstable and including means (F) biassing the switch to return to the ON position (I) upon release of manual operation to START position, and after having moved the switch through the ON position to the START position;

a glow plug energization relay (16);

a delayed operating timer circuit (26);

two energization circuits (3, 14, 15, 17; 36) for said at least one glow plug (20), a first one (3, 14, 15, 17) of said energization circuits including a heating element — temperature sensitive thermally responsive switch (19) having a heating resistance (17) and thermally responsive switch contacts (28) in heat transfer relation to said heating resistance (17), the heating resistance being serially connected with said at least one glow plug (20), the switch contacts (28) opening when the switch is heated due to current flow through said heating resistance (17), and the contacts of the glow plug energization relay (16);

the second one (36) of said energization circuits being directly connected to the START position (II) of said control switch (8) to apply direct power from said source (1) through said switch (8) to the at least one glow plug (20) while bypassing said heating resistance (17);

a glow plug control circuit (5) for said first glow plug energization circuit (3, 14, 15, 17), connected to the ON terminal (11) of the switch (8) and including a momentary-close plug pre-heat switch (21), a first junction (22), the control means (24) for said glow plug energization relay (16), and the contacts (25) of said delayed-opening timer circuit (26);

a controllable self-holding circuit (50, 32) connected to said junction (22) and including a controlled circuit breaking device (33);

a control connection (37-38-40) from the START position (II) of said switch (8) to the controlled circuit breaking device (33) of the self-holding circuit (50, 32) to open the self-holding circuit when the switch (8) is moved to tce START position (II);

a glow plug ready circuit (27, 28, 29, 26, 30) additionally connected to said first junction (22), said glow plug ready circuit including the switch contacts (28) of said thermally responsive switch (19) and the time control element (30) of the delayed operating timer circuit providing, when the switch (8) is placed in the ON position (I) and the momentary-close plug pre-heat switch (21) is operated, power to said first junction (22), glow plug energization relay (16) control means (24) to effect closing of the energization contact thereof and, through the switch contacts (28) of the thermally responsive switch (19) power to said delayed operating timer circuit (26), power supply continuing after release of the momentary-close switch (21) due to the self-holding circuit (50, 32) and providing, upon closing of the glow plug energization relay (16) power through said first energization circuit (3, 14, 15, 17) including said heating resistance (17) to said at least one glow plug (20); and indicator means (35) connected to be responsive to the state of the switch contacts (28) of the thermally responsive switch (19) and indicating when, after heating of the thermally responsive switch by current flowing through the heating resistance (17) thereof, a predetermined temperature has been reached to effect change-over of said thermally responsive contacts (28), change-over of said contacts interrupting energization of said timing circuit and initiating a timing delay interval to retain said first glow plug energization circuit in energized condition for the duration of the delay timing interval and permitting moving the switch (8) during said delay interval to the START position (II), but disconnecting the first glow plug energization circuit upon lapse of said delay timing interval.

2. System according to claim 1, further including a control connection from said START position (II) of the switch (8) to the controlled circuit breaking device (33) of the self-holding circuit (50, 32) to interrupt energization of the glow plug energization relay (16) upon movement of the switch (8) to the START position (II), energization of said at least one glow plug (20) being effected, when the switch is in START position, through said second one (36) of said energization circuits to apply direct power from said source (2) to said at least one glow plug when the switch (8) is moved to the START position.

3. System according to claim 2, wherein the controlled circuit breaking device (33) is a miniature relay.

4. System according to claim 1, wherein said thermally responsive switch (19) is positioned (18) to be additionally responsive to engine temperature.

5. System according to claim 1, wherein the starter motor (7) is directly connected (6) to said source (1);

and starter relay means are provided, connected to (39) and controlled by the START position (II, 13) of said switch.

6. System according to claim 1, wherein said glow plug energization relay (16) is a normally open power relay;

and wherein said timer delay operating circuit (26) is a normally open, momentary-close - delayed re-opening relay network.

7. System according to claim 6, wherein said relay network comprises a single relay (26) of the normally open - delayed re-opening type.

8. System according to claim 1, wherein said delayed operating timer circuit (26) comprises a control current relay means (42) and a thermostat — bi-metal switch (43) having a predetermined drop-off delay and including a heating means (46);

the heating means (46) of the thermostat — bi-metal switch (43) being energized by the glow plug pre-heat control circuit (5) through said first junction (22), said junction (22) being further connected to the operating terminals (45) of the control current relay means (42), the control element (44) of the control current relay means (42) being energized and de-energized in accordance with respective energization and de-energization of said glow plug pre-heat control circuit (5) and connected to and controlled by respective current flow or absence of current flow through the thermally responsive switch terminals (28) of said thermally responsive switch (19);

the thermostat bi-metal switch (43) having its operating terminals (25') connected in parallel to the operating terminals (45) of the control current relay means and having its heating element (46) connected to be energized upon energization of the glow plug pre-heat control circuit (5) and connected to and controlled by energization of said first junction (22), whereby, upon energization of the glow plug control circuit (5) and hence of said junction (22), the terminals (45) of said control current relay means (42) will close and, further, the thermostat bi-metal switch (43) will be energized and the parallel terminals thereof will close when the heating element (46) thereof has reached a sufficient temperature and, upon de-energization of the glow plug preheat control circuit (5) due to opening of the self-holding circuit (50, 32), the control current relay means (42) will open but, due to the delayed drop-off of the thermostat control switch, the terminals (25'), thereof will remain closed thus permitting continued current flow through the control means (24) of the glow plug energization relay (16) and continue energization thereof during the drop-off delay of said thermostat bi-metal switch (43).

9. System according to claim 1, wherein the delayed opening time of the timer circuit (26, 26') is in the order of about 15 seconds.

* * * * *